US005651275A

United States Patent [19]

Towne

[11] Patent Number: 5,651,275

[45] Date of Patent: Jul. 29, 1997

[54] SPRING BAIL

[76] Inventor: Mary D. Towne, 87 Russell St., Woburn, Mass. 01801

[21] Appl. No.: 614,498

[22] Filed: Mar. 13, 1996

[51] Int. Cl.[6] ..... A44C 11/02

[52] U.S. Cl. ..... 63/21

[58] Field of Search ..... 63/21, 22, 23, 63/2; 24/116 A, 116 R, 129 B

[56] References Cited

U.S. PATENT DOCUMENTS 229,257 6/1880 King ..... 63/21

511,944 1/1894 Gordon ..... 63/21 X 3,122,900 3/1964 Beghetto, Jr. ..... 63/23

5,440,900 8/1995 White ..... 63/2

*Primary Examiner*—Kien T. Nguyen

*Attorney, Agent, or Firm*—Hamilton, Brooks, Smith & Reynolds, P.C.

[57] ABSTRACT

A bail (FIGS. 1 and 2 no. 10) with a new use made possible by the addition of a spring (FIGS. 1 and 2 no. 12). The function being to hold a jewelry chain (FIGS. 1 and 2 no. 16) stationary so that the clasp of the chain will be stationary.

2 Claims, 2 Drawing Sheets

SPRING BAIL

BACKGROUND

1. Field of Invention

This invention relates generally to bails, including pendants with one or more bail formations, these are jewelers findings which hang on a chain, most bails hold a locket, pendant, cross and the like.

2. Description of Prior Art

Bails now in existence generally are used to hang on a chain, most bails hold a locket, pendant cross and the like. Jewelers classify bails as findings.

Most chains have a clasp which is used to connect the two ends of the chain and keep said two ends securely together. Thus a chain encircles the wearers neck. Such clasp is placed at the back of the wearers neck.

While a person is wearing a chain with a bail and locket, pendant, cross and the like, or a pendant with one or more bail formations, a chain slides through bails now in existence and travels around the wearers neck toward the front. The clasp now becomes very visible and highly unattractive. Sometimes the wearer is unaware. Those wearers that are aware will periodically move the clasp to the back of their neck because they want the clasp hidden from view.

OBJECTS AND ADVANTAGES

Spring Bail will make this unnecessary. Accordingly several objects and advantages of Spring Bail are:

(a) to hold a chain stationary while Spring Bail is in use.

(b) to provide wearer the best possible appearance because Spring Bail will hold a chain stationary.

(c) to provide ease of operation. To thread chain through bail hold spring or springs open so that said chain can be threaded between spring or springs and bail. After placement of chain said spring or springs release allowing spring or springs to exert enough force to keep chain stationary.

(d) to secure in place virtually every kind and size of chain.

(e) to provide simplicity for manufacture.

DRAWING FIGURES

In the drawings, closely related figures have the same number but different alphabetic suffixes.

REFERENCE NUMERALS IN DRAWINGS

| | |
|---|---|
| 10 bail | 12 spring |
| 14 tabs | 16 chain |
| 18 knob | 20 slot |

DESCRIPTION—FIGS. 1A, 2A

Figure 1A:
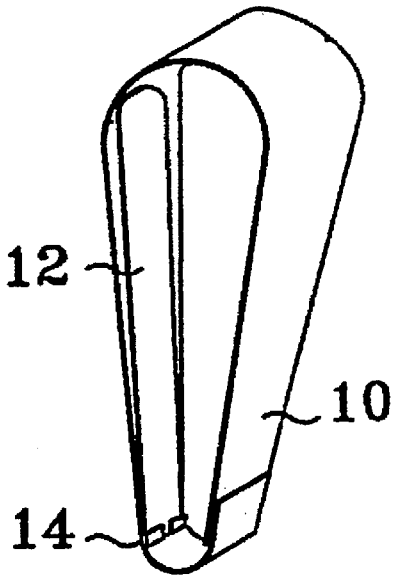
FIGS. 1A to 1D show various aspects of Spring Bail.

FIG. 1A Shows bail 10 with spring 12 attached by tabs 14 and spring 12 in closed position.

Figure 2A:
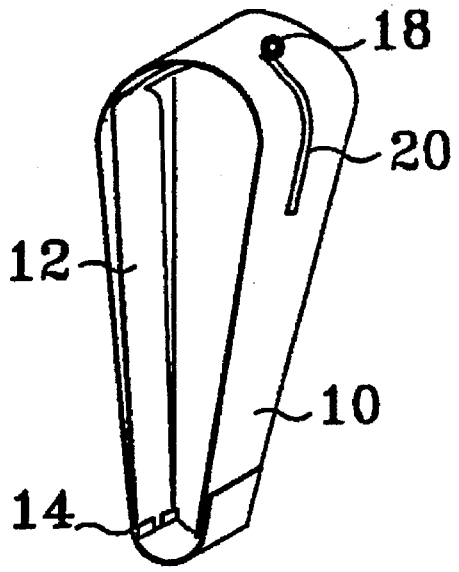
FIGS. 2A to 2D show various aspects of Spring Bail supplied with arm, slot, and knob.

FIG. 2A shows bail 10, spring with optional arm 12 in closed position, attached by tabs 14, knob 18, and slot 20.

OPERATION—FIGS. 1B, 1C, 1D, 2B, 2C, 2D

Figure 1B:
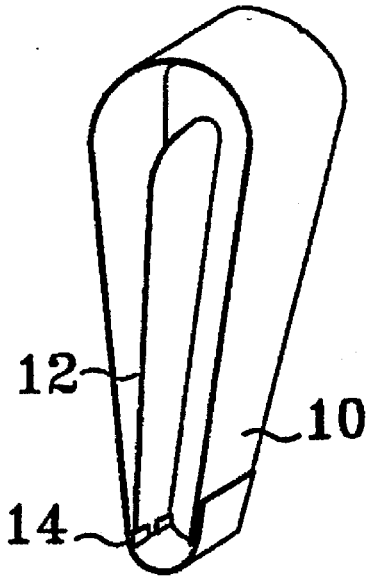

FIG. 1B shows bail 10, spring 12 in open position, pulled open by a person's fingernail (not shown) or implement, (not shown) and tabs 14 used to attach spring 12.

Figure 1C:
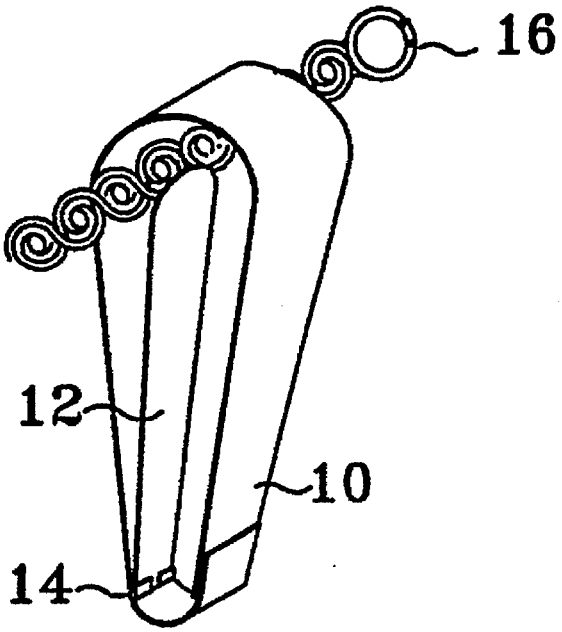

FIG. 1C shows bail 10, spring 12 in open position, tabs 14, and chain 16 in process of threading between spring 12, and bail 10.

Figure 1D:
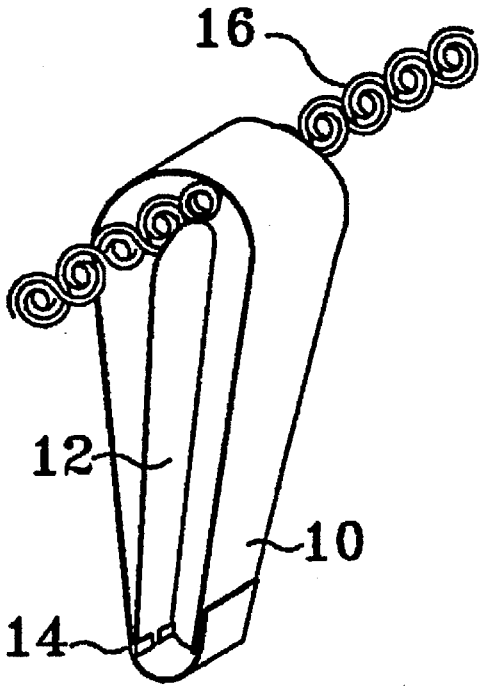

FIG. 1D shows bail 10, tabs 14, chain 16 threaded through and in place, spring 12 now applying force to keep chain 16 stationary.

Figure 2B:
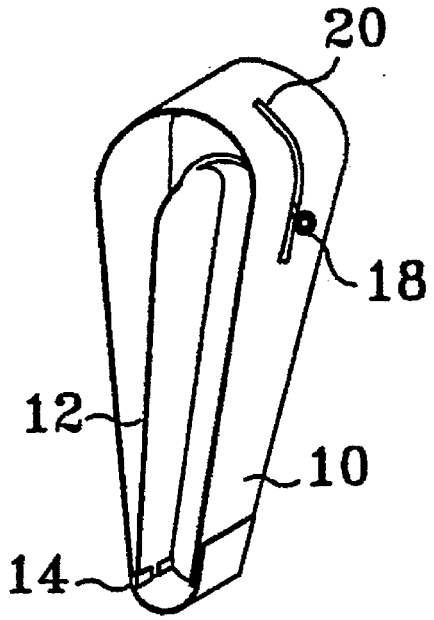

FIG. 2B shows bail 10, tabs 14, spring 12 in open position, pulled down by a person's finger (not shown) or thumb (not shown) via knob 18 through slot 20.

Figure 2C:
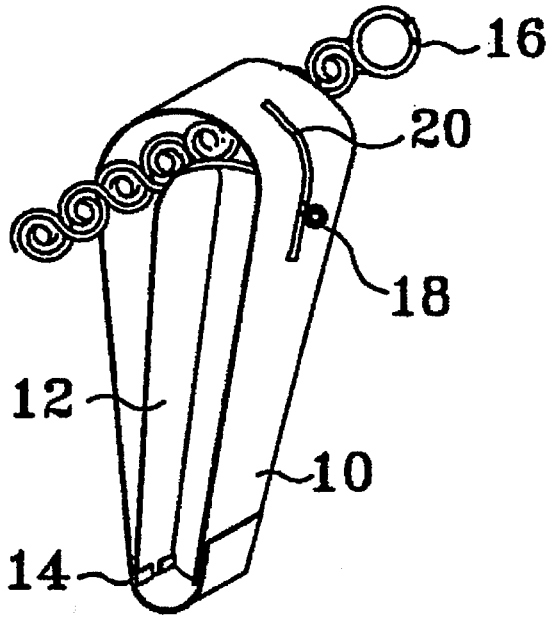

FIG. 2C shows bail 10, tabs 14, spring 12 in open position, held down by a person's finger (not shown) or thumb (not shown) via knob 18 through slot 20, chain 16 now inserted to be threaded through by person (not shown).

Figure 2D:
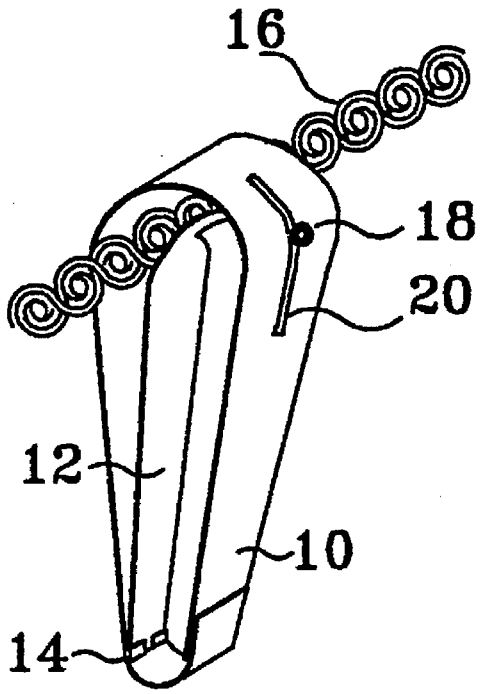

FIG. 2D shows bail 10, tabs 14, chain 16 threaded through and in place, spring 12 now applying force to keep chain 16 stationary, knob 18 now in up position and slot 20.

SUMMARY, RAMIFICATIONS, AND SCOPE

Accordingly, the reader will see that my Spring Bail provides some unprecedented advantages over present day bails in that it provides a way to keep a jewelry chain clasp in place;

it provides a way to keep a jewelry chain attractive;

it provides a way to keep virtually every kind and size of jewelry chain stationary.

Descriptively in the above are illustrated the preferred embodiments of my Spring Bail. There are different kinds and shapes of bails, so the sizes, kinds and shapes of Spring Bail can not be limited. For example a bail could be oval, round, triangular, trapezoidal, split, or include a pendant Therefore the shape, kind, and number of springs, and attachments of Spring Bail would vary accordingly for functionality and ease of manufacture.

A latitude of modification change and substitution is intended in the foregoing disclosure and in some instances some features of the invention Spring Bail will be employed without a corresponding use of other features. Accordingly, it is appropriate that the appended claims be construed broadly and in a manner consistent with the spirit and scope of the invention Spring Bail, herein.

I claim:

1. A jewelry finding comprising:

a bail for hanging on a chain, the bail being formed in a single loop and having an inner surface; and a spring member coupled to the inner surface of the bail, the spring member being resiliently biased against the inner surface of the bail and being capable of trapping the chain in place against the inner surface of the bail such that the chain is held relatively stationary.

2. The jewelry finding of claim 1 further comprising a knob attached to the spring member and accessible outside of the loop of the bail for pulling the spring member into an open position.

* * * * *